US005908072A

United States Patent [19]

Hawkins

[11] Patent Number: 5,908,072

[45] Date of Patent: Jun. 1, 1999

[54] NON-METALLIC CENTRALIZER FOR CASING

[75] Inventor: Samuel P. Hawkins, Mineral Wells, Tex.

[73] Assignee: Frank's International, Inc., Lafayette, La.

[21] Appl. No.: 08/850,525

[22] Filed: May 2, 1997

[51] Int. Cl.[6] ..... E21B 17/10

[52] U.S. Cl. ..... 166/241.6; 166/241.1; 166/241.3

[58] Field of Search ..... 166/241.1, 241.2, 166/241.3, 241.4, 241.6; 175/325.1, 325.5

[56] References Cited

U.S. PATENT DOCUMENTS

| | | | |
|---|---|---|---|
| 3,528,499 | 9/1970 | Collett | 166/175 |
| 3,933,203 | 1/1976 | Evans | 166/241.6 |
| 3,963,075 | 6/1976 | Evans | 166/241.6 |
| 4,050,514 | 9/1977 | Prenn | 166/176 |
| 4,088,185 | 5/1978 | Carson | 166/176 |
| 4,757,861 | 7/1988 | Klyne . | |
| 4,858,688 | 8/1989 | Edwards et al. . | |
| 4,919,202 | 4/1990 | Clintberg | 166/176 |
| 5,095,981 | 3/1992 | Mikolajczyk | 166/241.6 |
| 5,115,863 | 5/1992 | Olinger | 166/241 |
| 5,179,140 | 1/1993 | Ariannejad | 523/440 |
| 5,191,938 | 3/1993 | Sable et al. | 166/378 |
| 5,247,990 | 9/1993 | Sudol et al. | 166/241.3 |
| 5,277,254 | 1/1994 | Rullman et al. | 166/241.4 |
| 5,339,896 | 8/1994 | Hart et al. | 166/241.1 |
| 5,492,174 | 2/1996 | O'Hair | 166/241.4 |
| 5,692,562 | 12/1997 | Squires | 166/241.3 X |

FOREIGN PATENT DOCUMENTS 2171436 8/1986 United Kingdom .

OTHER PUBLICATIONS

Ray Oil Tool Company Brochure: Solid Straight Blade Centralizers (Undated).

Downhole Products (UK) Ltd. Brochure: The Spir–O–Lizer (Undated).

*Primary Examiner*—George Suchfield

*Attorney, Agent, or Firm*—Matthews, Joseph, Shaddox & Mason, P.L.L.C.; Henry L. Ehrlich

[57] ABSTRACT

A non-metallic centralizer for casing having a tubular, plastic sleeve adapted to fit closely about a joint of casing, said sleeve having a plurality of blades extending substantially longitudinally along an outer surface of said sleeve. The non-metallic centralizer having strength characteristics capable of withstanding the forces encountered in casing operations. The non-metallic centralizer is non-sparking for use in hazardous environments, abrasion and wear resistant, and provides protection from electrolysis between adjacent casing strings. The non-metallic centralizer is light weight, allowing increased transportation capacity at a economical cost.

15 Claims, 3 Drawing Sheets

NON-METALLIC CENTRALIZER FOR CASING

TECHNICAL FIELD

The present invention relates to centralizers for centering pipe strings in well bores and within in other pipe strings and more particularly to a centralizer for centralizing pipe strings in well bores and within in other pipe strings that is non-metalic, wear and abrasion resistant and safe for use in hazardous environments.

BACKGROUND ART

In the completion of oil and gas wells it is standard practice to set or cement at least one string of casing within the well bore. Casing strings are cemented in the well bore to prevent fluids from migrating from the production zone through the annulus between the casing string and the well bore to the surface or other zones where for example fresh water may be contaminated. In addition, there are regulations which require that some zones be cemented off.

In cementing a casing string, a cement slurry is pumped down the interior of the casing string, out the lower end, into the annulus between the string and the well bore. However, to effect an efficient cementing job, the complete annulus needs to be cemented without pockets in the cement and without areas in which the string is contacting the wall of the well bore. To facilitate obtaining an effective cementing job the casing is commonly centered in the well bore with centralizers which are disposed about the casing string. In addition, the centralizers aide in running the pipe into the hole without hanging up.

Centralizers may also be used on casing or pipe strings, such as tubing, which are hung within another string of casing or pipe. These inner strings may be cemented within the outer pipe string or they may not be.

Centralizers for casing, tubing or pipe commonly are constructed of a low carbon steel having a tubular body or sleeve adapted to fit around a pipe joint. These prior art centralizers usually include outwardly bowed springs having opposing ends connected to opposite ends of the sleeve. Although the resiliency of the bow strings enables them to move through tight spots in the well bore, they may not support the weight of the casing string, especially in a highly deviated well bore.

In another type prior art centralizer, the bow strings are replaced by solid strips of metal which are tapered at each end to provide outer spaced bearing surfaces for engaging the well bore or the outer casing. Although less prone to collapse than bow springs under the weight of the casing string, these metal strips are often not strong enough to prevent bending upon contacting an obstruction or turn in the well bore. As a result, the centralizer and the casing may become wedged in the well, and, in any case become unsuitable for providing a suitable cementing job.

These prior art metal centralizers have further drawbacks, especially, when run and set within another string of pipe. One of the drawbacks is when the metal centralizer is run into or when it vibrates due to slugs in production it contacts the outer pipe string and may cause a spark, which can be very hazardous in the hydrocarbon filled well. Also, these metal centralizers create a corrosion problem with the casing strings which it contacts through electrolysis. These metal centralizers also are susceptible to damage when running acid and circulating the acid back out of the hole. Additionally, there is a concern with scrapping the inner diameter of stainless steel tubing when running stainless/duplex stainless steel tubing having metal centralizers.

It would be a benefit, therefor, to have a centralizer adapted to fit about a string of pipe for centering the pipe in a well bore or within an outer string of pipe which is constructed of a non-metallic material. It would be further benefit to have a centralizer which has non-sparking properties. It would be a still further benefit to have a centralizers that provides cathodic protecting between strings of casing. It would be an additional benefit to have a centralizer which is resistant to deterioration due to acid. It would be a still further benefit to have a non-metallic centralizer which is lightweight while having sufficient strength to withstand the forces encountered in casing operations.

SUMMARY OF THE INVENTION

It is thus an object of the invention to provide a non-metallic centralizer that provides structural strength capable of withstanding the forces exerted by a string of pipe contacting a well bore or an outer string of pipe.

It is a further object of the invention to provide a non-metallic centralizer that is non-sparking when contacting metal pipe strings.

It is a still further object of the invention to provide a non-metallic centralizer that does not promote electrolysis when in contact with a pipe string and provides cathodic protection between strings of pipe.

It is a still further object of the invention to provide a non-metallic centralizer that is resistant to acid.

It is a still further object of the invention to provide a non-metallic centralizer that is inexpensive to manufacture.

It is a still further object of the invention to provide a non-metallic centralizer that is lightweight and has the tensile and compressive strength required to withstand the forces encountered in centralizing casing as opposed to the forces encountered by sucker rod guides and tube spacers.

Accordingly, a centralizer for centering casing within a well bore or within another string of casing is provided. The non-metallic centralizer for casing includes a tubular, plastic sleeve adapted to fit closely about a joint of casing, said sleeve having a plurality of blades extending substantially longitudinally along an outer surface of said sleeve.

In a preferred embodiment the centralizer is formed of an injection molded polyurethane. The centralizer may be formed of a glass or graphite impregnated plastic, such as AMODEL A-1145 HS by Amoco or KYNAR 370 from the Penwalt Corporation as well as other non-metallic composite materials having similar strength, temperature resistant and acid resistant characteristics.

Preferably, the blades having a bearing surface for bearing against a well bore or an outer casing in which the casing carrying the centralizer is disposed. The blades extend outwardly from the tubular sleeve to space the carrying casing string from the well bore or outer casing string.

It is also preferred that the blades have opposing ends tapered outwardly toward one another. However, it is not necessary that the blade ends be tapered. It may also be desired to have the blades sweep at an angle as they extend longitudinally down the sleeve.

The non-metallic centralizer may be positioned on the pipe and allowed to float between the collars at adjacent casing joint connections. The centralizer may be connected to the casing joint by an adhesive. The centralizer may be connected to the casing joint by set screw which are adjustably disposed through the centralizer so as to engage the casing joint. The centralizer may be fixedly connected to the casing joint via stop collars or rings connected to the casing string adjacent opposing ends of the centralizer. The stop rings may be of any type well known in the art such as the Frank's SB stop ring.

Additionally, the stop rings may be constructed of a non-metallic material such as the non-metallic centralizer of this invention. Preferably, a stop collar formed of the same or substantially same non-metallic material as the centralizer would include an outer ring, an inner ring positioned between the outer ring and the casing joint to be engaged and having an inner face for gripping the casing joint, and an activating mechanism for securing the inner ring to the outer ring and facilitate engagement with the casing joint.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
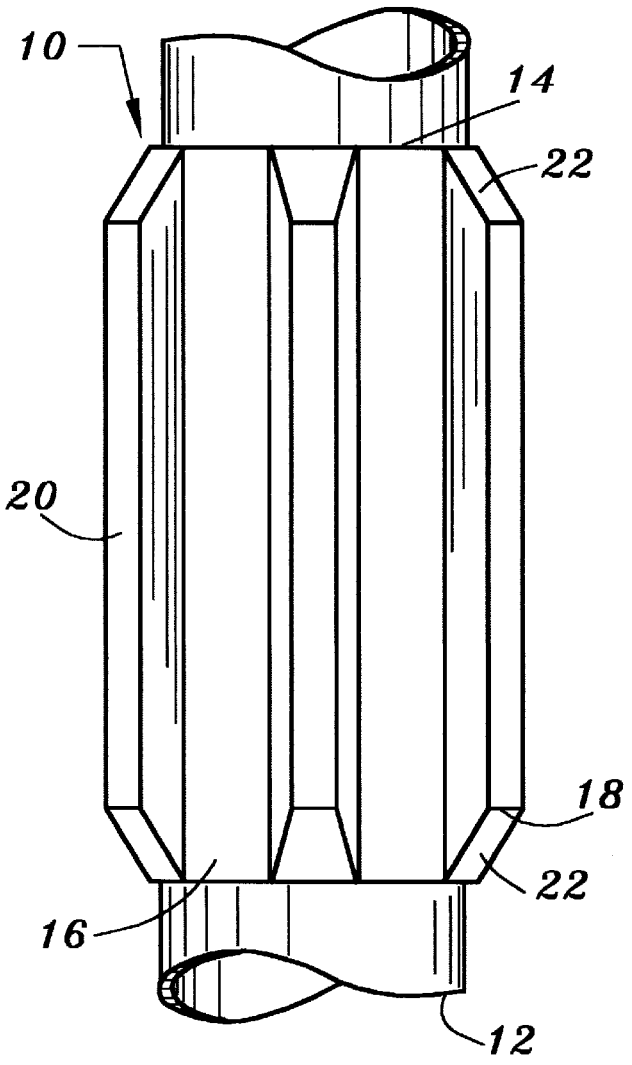
FIG. 1 is a perspective view of an exemplary embodiment of the non-metallic centralizer.

FIG. 1 is a perspective view of an exemplary embodiment of the non-metallic centralizer of the present invention generally designated by the numeral 10. As shown in FIG. 1, centralizer 10 is positioned about a joint of casing 12 and is connected thereto with an adhesive.

Centralizer 10 includes a continuous, tubular, non-metallic sleeve 14, an outer surface 16, and blades 18. Blades 18 include a bearing surface 20 and opposing ends 22 and 22' which are tapered outwardly towards one another. Blades 18 and sleeve 14 are of a unitary construction. As shown in FIG. 1, blades 18 extend substantially longitudinally along outer surface 16 and as shown are straight. However, blades 18 may extend longitudinally along outer surface 16 but be swept, or curved.

Figure 2:
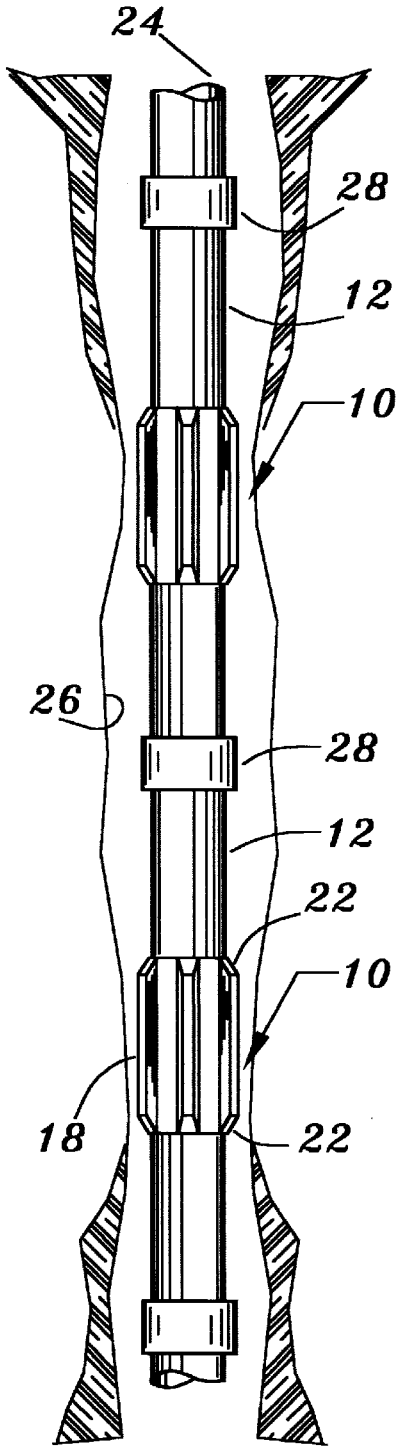
FIG. 2 a perspective view of an exemplary embodiment of the non-metallic centralizers connected along a casing string and positioned in a well bore.

FIG. 2 is a perspective view of an exemplary embodiment of non-metallic centralizers 10 connected along a casing string 24 and positioned in a well bore 26. Centralizers 10 positioned about casing joints 12. Centralizers 10 may be connected to joints 12 by means such as adhesive, set screws, stop collars or rings or allowed to float on joint 12 between connection collars 28.

In the preferred embodiment, opposing ends 22 and 22' are tapered, however, they may be at a right angle. Preferably, opposing ends 22 and 22' are tapered at an angle of 45 degrees, however, this is not necessary. It is desired to taper opposing ends 22 to aide in running casing string 24 in well bore 26. When running casing string 24 in well bore 26, centralizers 10, collars 28 and joints 12 will at times hang or bear against protruding portions of well bore 26 requiring that string 24 be raised and run back in, therefor, both opposing ends 22 are tapered. In addition, tapered ends 22 alleviate the problem of solids building up adjacent centralizer 10 when fluid is being circulated through the annulus.

As shown in FIG. 2, blades 18 extend outwardly from sleeve 14 so as to space casing string 24 away from well bore 26. Bearing surface 20 of blade 18 is adapted to contact well bore 26 and maintain separation between casing string 24 and well bore 26.

Figure 3:
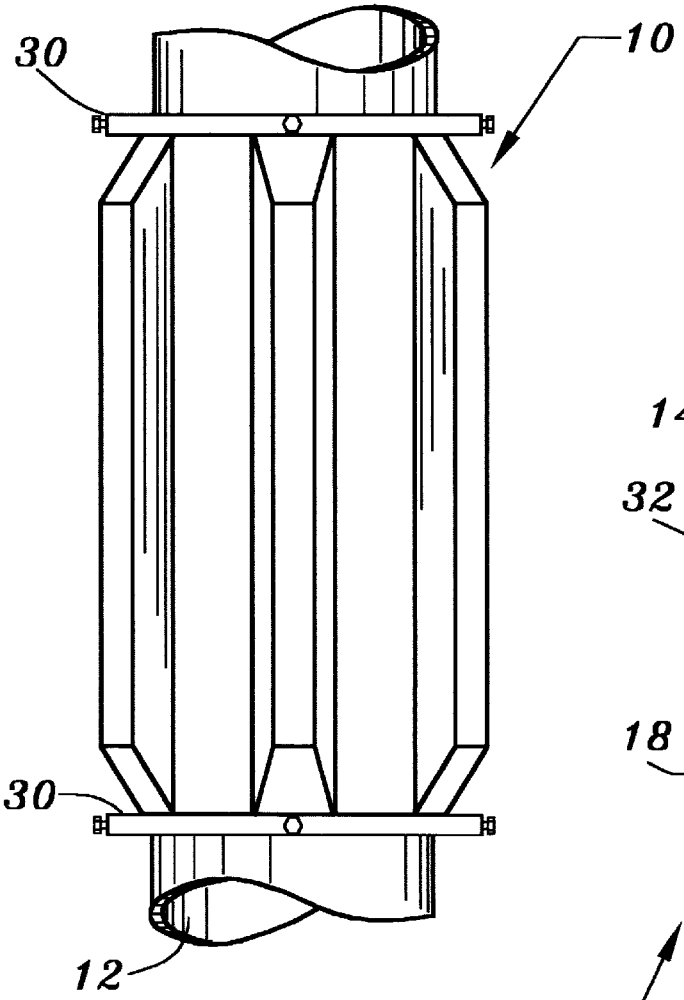
FIG. 3 is a perspective view of a preferred embodiment of the centralizer fixedly attached to a joint of casing by a pair of non-metallic stop-rings.

FIG. 3 is a perspective view of a preferred embodiment of centralizer 10 fixedly attached to casing joint 12 by a pair of non-metalic stop-rings 30. Stop-rings 30 are constructed of the same material as centralizer 10 to form a homogeneous, non-metallic system.

Figure 4:
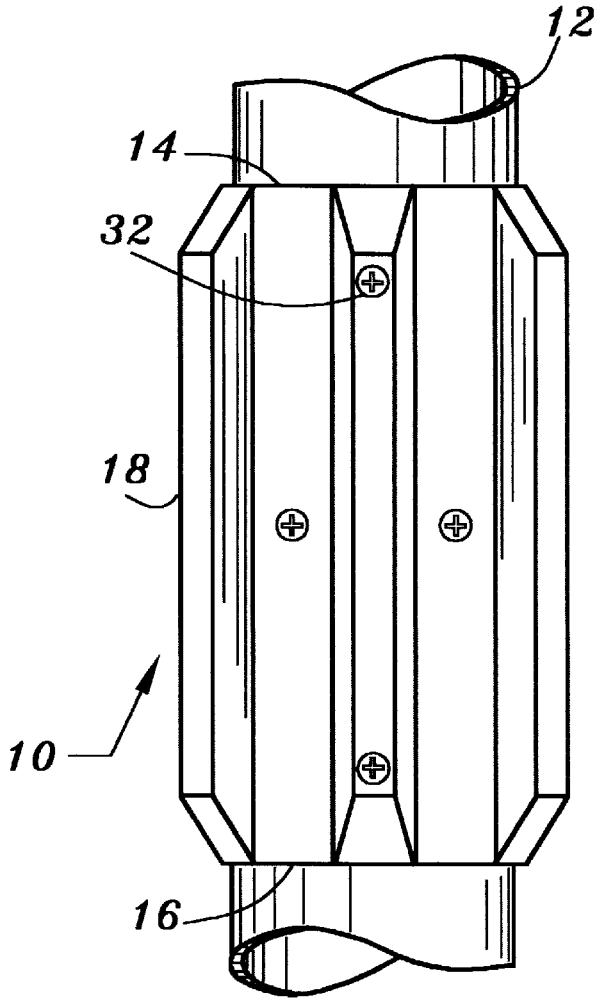
FIG. 4 is a perspective view of an exemplary embodiment of the present invention wherein the centralizer is connected to a casing joint by set screws.

FIG. 4 is a perspective view of an exemplary embodiment of the present invention wherein centralizer 10 is connected to casing joint 12 by set screws 32. In this embodiment of centralizer 10, threaded holes are provided through centralizer 10 to dispose set screws 32, thereby, allowing centralizer 10 to be fixedly attached to casing joint by threading screws 32 into engagement with casing 12.

In the preferred embodiment the non-metallic centralizer 10 is constructed of a polyurethane. The polyurethane centralizer 10, is capable of withstanding operating temperatures from 200 degrees Fahrenheit to 300 degrees Fahrenheit. Centralizer 10 is also capable of operating in an environment of at least 20 percent hydrochloric acid. In addition, centralizer 10 is capable of withstanding 55,000 pounds of force when positioned about joint 12.

In the preferred embodiment, centralizer 10 is formed through a reaction injection molding process wherein two streams, a MDI isocyanate, part A of the mixture, and a polyurethane polyol, part B of the mixture, are injected from a mixhead into a closed mold to form a polyurethane elastomeric centralizer 10. A preferred embodiment of this invention is constructed by this injection molding process using Bayflex XGT-11 from MILES. Typical properties of Bayflex XGT-11 are presented below:

PHYSICAL PROPERTIES

- Postcured NO (conditions
- Density(lbs./cu.ft.) 65
- Flexual Modulus (kpsi)
  - @+23° C. 100
  - @−30 ° C. 174
  - @+70 ° C. 42
- Tensile(psi) 4,000
- Elongation (%) 100
- Notched Izod (ft-lbs/in) 7
- Hardness (D scale) 69
- Die C tear (phi) 670
- CLTE (in/inx$10^4$/°C.) 105

PROCESS CONDITIONS

- Chemical Temperature (°F.)
  - Component A 90–100
  - Component B 90–100
- Mold Temperature (°F.) 150–160
- Nucleation Level (Comp. B spec. gravity) 0.75
- Maximum shot time (sec) 4–5
- Demold Time (sec) 90
- Mixing Ratio Comp. A; Comp. B (pbw) 152:100

In another preferred embodiment centralizer 10 is constructed of a fluoropolymer such as KYNAR 700 Series (unfilled) or KYNAR 370 Series which is a 20 percent graphite reinforced fluoropolymer. KYNAR is a product of the Penwalt Corporation. Typical properties of the KYNAR 700 and 370 are set out below:

| | METHOD | UNITS | 700 SERIES | 370 SERIES |
|---|---|---|---|---|
| Melting Point Range | ASTM D3418 | Fahrenheit (F) | 329–338 | 329–338 |
| Specific Gravity | | | 1.77–1.79 | 1.84–1.86 |
| Refractive Index | ASTM D542 | $n^{25}D$ | 1.42 | N/A |
| Water Absorption | ASTM D570 | Percent | .01–.03 | .05 |
| Tensile Strength at yield | ASTM D638 | psi | 6,000–8,000 | none |
| Tensile Strength at break | ASTM D638 | psi | 5,000–6,000 | 5,500–8,000 |
| Elongation at yield | ASTM D638 | Percent | 7–13 | none |
| Elongation at break | ASTM D638 | Percent | 50–250 | 4–20 |
| Tensile Modulus | ASTM D882 | psi | $200–300 \times 10^3$ | 584,000 |
| Flexural Modulus | ASTM D790 | psi | $200–325 \times 10^3$ | N/A |
| Hardness | ASTM | Shore D | 76–80 | 75–79 |

Another example of a material suitable for construction of centralizer 10 is a 40 percent fiberglass/mineral filled, chemically coupled homopolymer polypropylene, of injection mold quality. A sample of this material is HPP40GR9923NA from FERRO Corporation.

Another example of a suitable product is AMODEL A-1145 HS from Amoco. This product is a 45 percent glass reinforced, heat stabilized polyphthalamide (PPA) which exhibits a high heat distortion temperature, high flexural modulus and high tensile strength. This product may be processed using conventional equipment and methods.

These examples among other non-metallic materials may be used in the construction and forming of centralizer 10. It is critical that centralizer 10 be constructed of a material have strength characteristics capable of withstanding the forces encountered in casing operations.

Figure 5:
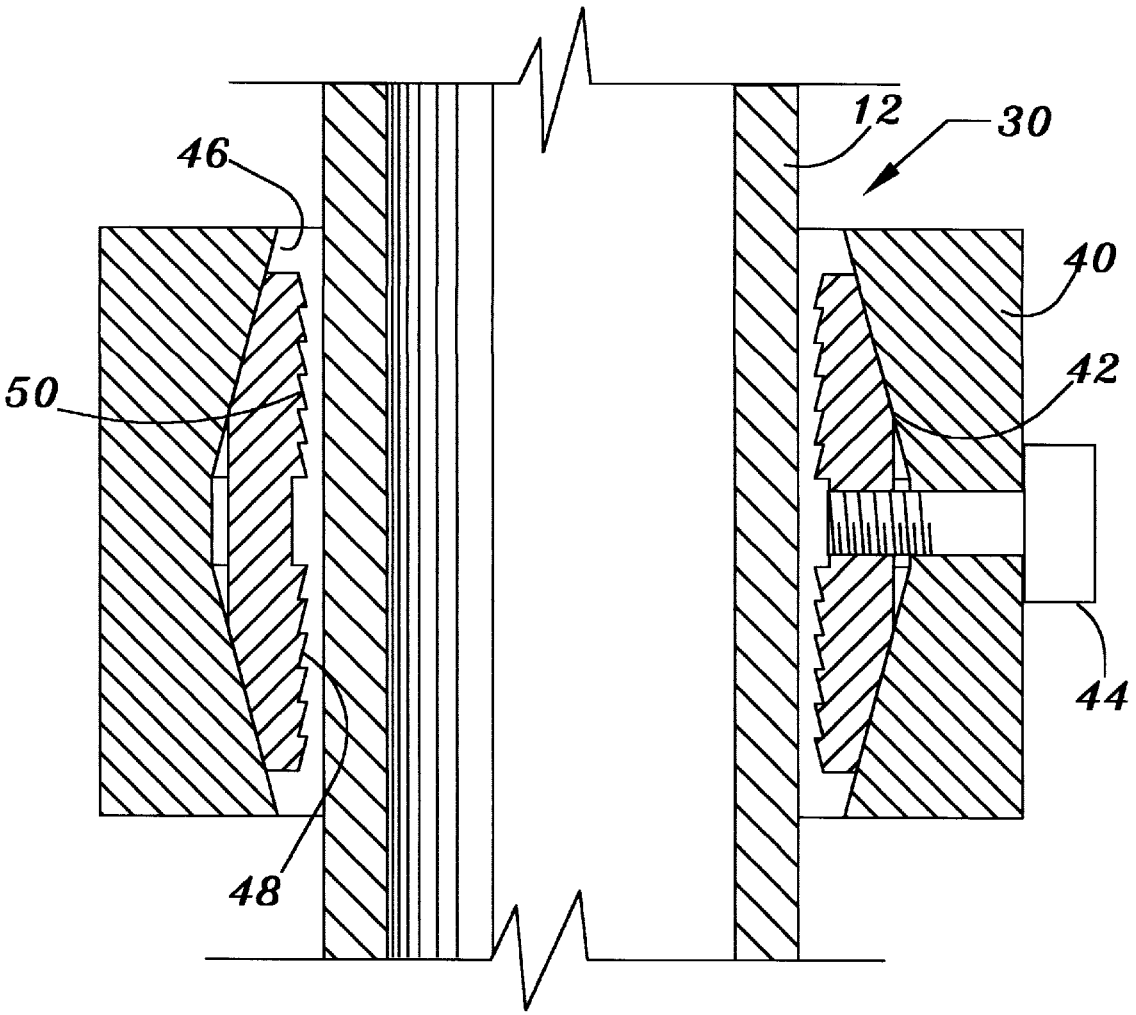
FIG. 5 is a side, cross-sectional view of the non-metallic stop ring as shown in FIG. 3.

FIG. 5 is a side, cross-sectional view of the non-metallic stop ring 30 as shown in FIG. 3. Stop ring 30 includes an outer ring 40, an inner ring 42 and an activating means 44.

Outer ring 40 is constructed of a non-metallic material, preferably being the same type of material as centralizer 10 is constructed. Outer ring 40 has a substantially V-shaped inner face 46 for maintaining inner ring 42 and outer ring 44 in a functional relation.

Inner ring 42 has a gripping face 48 for engaging casing joint 12. Gripping face 48 may have teeth 50 oriented to grip casing joint 12 when joint 12 is moved either in an upward or downward direction.

Inner ring 42 is a split element wherein, activating means 44 is a screw threadably connected through outer ring 40 and contacting inner ring 42 so that the screw may be threaded into contact with casing joint 12.

In operation, stop rings 30 are placed on joint 12 straddling centralizer 10, as shown in FIG. 3. Activating screws 44 are threaded through outer ring 40 into contact with joint 12 and urge inner ring 42 in contact with joint 12. When a force is exerted in an upward or downward direction by joint 12 relative to stop ring 30, inner ring 42 slides along V-shaped face 46 urging inner ring 42 and thus stop ring 30 in a locking relationship with joint 12.

It can be seen from the preceding description that a non-metallic centralizer for centering a string of pipe within a well bore or another string of pipe which provides structural strength capable of withstanding the forces exerted by a string of pipe contacting a well bore or an outer string of pipe, is non-sparking when contacting metal pipe strings, does not promote electrolysis when in contact with a pipe string and provides cathodic protection between strings of pipe, and is resistant to acid has been provided.

It is noted that the embodiment of the non-metallic casing centralizer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A non-metallic centralizer for casing comprising:

a tubular plastic sleeve forming an axial bore therethrough, said sleeve adapted to fit closely about a joint of casing, said sleeve having blades extending substantially longitudinally along an outer surface of said sleeve.

2. The non-metallic centralizer of claim 1, wherein:

said blades having a bearing surface for bearing against a well bore or an outer casing in which said casing carrying said centralizer is disposed.

3. The non-metallic centralizer of claim 1, wherein:

said blades have opposing ends tapered outwardly toward one another.

4. The non-metallic centralizer of claim 2, wherein:

said blades have opposing ends tapered outwardly toward one another.

5. The non-metallic centralizer of claim 1, wherein:

said tubular sleeve and said blades are formed of a polyurethane.

6. The non-metallic centralizer of claim 5, wherein:

said centralizer is formed by reaction injection molding.

7. A non-metallic centralizer for casing comprising:

a tubular, glass impregnated plastic sleeve forming an axial bore therethrough, said sleeve adapted to fit closely about a joint of casing, said sleeve having blades extending substantially longitudinally along an outer surface of said sleeve.

8. The non-metallic centralizer of claim 7, wherein:

said blades having a bearing surface for bearing against a well bore or an outer casing in which said casing carrying said centralizer is disposed.

9. The non-metallic centralizer of claim 7, wherein:

said blades have opposing ends tapered outwardly toward one another.

10. The non-metallic centralizer of claim 8, wherein:

said blades have opposing ends tapered outwardly toward one another.

11. A non-metallic centralizer for casing comprising:

a tubular, graphite impregnated plastic sleeve forming an axial bore therethrough, said sleeve adapted to fit closely about a joint of casing, said sleeve having blades extending substantially longitudinally along an outer surface of said sleeve.

12. The non-metallic centralizer of claim 11, wherein:

said blades having a bearing surface for bearing against a well bore or an outer casing in which said casing carrying said centralizer is disposed.

13. The non-metallic centralizer of claim 11, wherein:

said blades have opposing ends tapered outwardly toward one another.

14. The non-metallic centralizer of claim 12, wherein: said blades have opposing ends tapered outwardly toward one another.

15. A non-metallic centralizer for casing comprising:

a tubular plastic sleeve adapted to fit closely about a joint of casing, said sleeve having a plurality of blades extending substantially longitudinally along an outer surface of said sleeve; and a stop ring connected to said casing joint adjacent opposing ends of said centralizer, said stop ring comprising an outer plastic ring having an inner face for urging an inner face into contact with said casing joint and an activating means for securing said outer ring and said inner ring.

* * * * *